US012501964B2

(12) United States Patent
Goverud-Holm et al.

(10) Patent No.: US 12,501,964 B2
(45) Date of Patent: Dec. 23, 2025

(54) ASSEMBLY FOR ANCHORAGE OF A BINDING PART IN A SKI SHOE

(71) Applicant: ROTTEFELLA AS, Lierstranda (NO)

(72) Inventors: Thomas Goverud-Holm, Hof (NO); Magnus Anderssen, Nesodden (NO); Jørn Frode Danielsen, Drøbak (NO); David Klovning Flem, Slependen (NO); Edward Jones, Lommedalen (NO)

(73) Assignee: ROTTEFELLA AS, Lierstranda (NO)

( * ) Notice: Subject to any disclaimer, the term of this patent is extended or adjusted under 35 U.S.C. 154(b) by 0 days.

(21) Appl. No.: 18/713,394

(22) PCT Filed: Nov. 25, 2022

(86) PCT No.: PCT/NO2022/050271
§ 371 (c)(1),
(2) Date: May 24, 2024

(87) PCT Pub. No.: WO2023/096498
PCT Pub. Date: Jun. 1, 2023

(65) Prior Publication Data

US 2025/0017314 A1 Jan. 16, 2025

(30) Foreign Application Priority Data

Nov. 25, 2021 (NO) ..... 20211430

(51) Int. Cl.
*A43B 5/04* (2006.01)

(52) U.S. Cl.
CPC ..... *A43B 5/0494* (2013.01); *A43B 5/0413* (2013.01)

(58) Field of Classification Search
CPC ... A43B 5/0403; A43B 5/0413; A43B 5/0417; A43B 5/0494
See application file for complete search history.

(56) References Cited

U.S. PATENT DOCUMENTS 4,334,367 A 6/1982 Salomon
4,787,155 A 11/1988 Callegari
(Continued)

FOREIGN PATENT DOCUMENTS

DE 102009059968 A1 6/2011
EA 038641 B1 9/2021
(Continued)

OTHER PUBLICATIONS

Russian Office Action for Application No. 2024117312/03(038786) issued issued on Nov. 26, 2024.
(Continued)

*Primary Examiner* — Ted Kavanaugh

(57) ABSTRACT

The present invention relates to an assembly for anchorage of a binding part (1) in a ski shoe, wherein the binding part (1) comprises an oblong, round part of metal or other material with pins (2) projecting at either side, wherein the binding part (1) is arranged in a sole (8), such that the pins project at either side of the front end of the sole (8) transversely of the longitudinal direction of a ski. The binding (1) is mounted onto or comprises at least one anchorage part (3) with openings (4) and holders-on (6), wherein the anchorage part (3) forms an opening into which the binding part (1) fits, the anchorage part (3) and the bonding part (1) comprising at least to attachment points (5) in the circumference of the round binding part (1).

11 Claims, 8 Drawing Sheets

(56) References Cited

U.S. PATENT DOCUMENTS

Figure 1A:
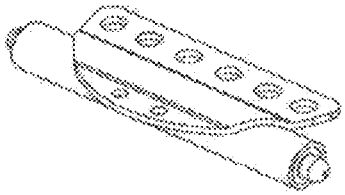
Fig. 1a Prior Art

| | | | | |
|---|---|---|---|---|
| 4,930,233 | A * | 6/1990 | Provence | A43B 5/0413 280/615 |
| 6,065,769 | A * | 5/2000 | Simonetti | A63C 9/20 280/615 |
| 7,931,292 | B2 * | 4/2011 | Miralles | A43B 5/0413 36/117.3 |
| 2005/0178024 | A1 | 8/2005 | Hauglin | |
| 2008/0023956 | A1 | 1/2008 | Fischli | |

FOREIGN PATENT DOCUMENTS

| | | | |
|---|---|---|---|
| EP | 169429 | A1 | 1/1986 |
| EP | 2946818 | A1 | 11/2015 |
| NO | 312742 | B1 | 7/2002 |
| RU | 2394621 | C2 | 7/2010 |
| RU | 2652572 | C2 | 4/2018 |

OTHER PUBLICATIONS

International Search Report issued in PCT/NO2022/050271, mailed on Nov. 26, 2024.
International Search Report of the ISA issued in PCT/NO2022/050271, mailed Jan. 13, 2023; ISA/XN.
Extended European Search Report for Application No. 22899160.0 dated Sep. 25, 2025.

* cited by examiner

SECTION B-B

ASSEMBLY FOR ANCHORAGE OF A BINDING PART IN A SKI SHOE

CROSS-REFERENCE TO RELATED APPLICATIONS

This application is a 371 U.S. National Phase of International Application No. PCT/NO2022/050271 filed Nov. 25, 2022, which claims priority to Norway Application No. 20211430 filed on Nov. 25, 2021. The entire disclosures of the above applications are incorporated herein by reference.

The present invention relates to an assembly for anchorage of a binding part in a ski shoe, more specifically a ski shoe with a flexible sole. The binding part comprises an oblong, round part of metal or other material, wherein the binding part comprises pins that project at either end. The binding part is arranged transversely of the front end of the sole, the pins projecting at either side of the front end of the sole, transversely of the longitudinal direction of a ski.

Prior art includes a binding part comprising an oblong, round part of metal or other material, wherein the binding part is arranged transversely of the front end of a shoe sole, and the pins project on either side of the front end of the sole, transversely of the longitudinal direction of a ski. In the practical embodiments seen so far, the ski shoe has been of a rigid type made of carbon fibre. In the theoretical embodiments so far, the images have shown rigid ski shoes of the type suitable for alpine or randonee skiing, ref. EP2946818A1. This publication does not state anything about how the binding part is anchored in the ski shoe.

A flexible shoe sole must be made of a suitable plastic material, possibly a two- or multi-cast of plastic materials of different rigidity and properties, wherein the shape and thickness of the plastic material offer the correct bending profile for the skiing activity for which it is intended. An oblong, round part of metal with pins projecting at either end will for several reasons not be sufficiently fixed in something flexible. Firstly, there is no or poor bonding between a metal surface and a plastic material. Secondly, a typical plastic material could extend and be torn apart in the area around the metal part, particularly as the thickness of the plastic material is low in the areas around the metal part. The metal part constituting a binding part must be coupled to a corresponding, complementary binding part, which is fixedly mounted on a ski, and together they must constitute a fixed coupled, torsion-stiff unit rotatable i the longitudinal direction, which must be capable of absorbing very strong forces. These forces will be transferred to the ski sole through the plastic material that encloses the oblong, round metal part. It is decisive that the ski sole and the metal part in the ski sole are fixedly connected and can withstand the intended use.

Figure 1B:
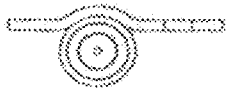
Fig. 1b Prior Art
Figure 2A:
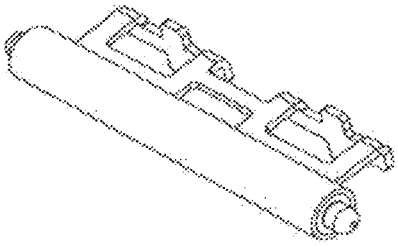
Fig. 2a Prior Art
Figure 2B:
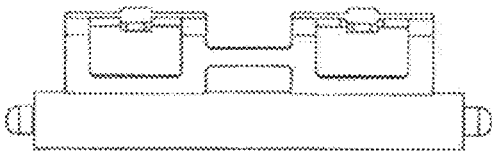
Fig. 2b Prior Art

In previous types of ski soles with a binding part of metal, e.g. NNN ski soles, the pin consists of a thin, round metal piece that is bent at the ends, first backwards and then upwards, the end parts constituting anchorages in the plastic material of which the ski sole is manufactured, ref. FIGS. 3*a-b*. However, due to the geometry, configuration and functionality of the NNN ski soles, the torsion rigidity and other forces do not become as strong as is the case of the solution according to the present invention. Thus, the anchorage system of the NNN ski soles is not suitable for the new type of ski binding described here. It has been attempted, but the ski sole is torn apart. It has also been attempted to weld a flat anchorage plat onto the oblong, round metal part constituting the binding part in the ski sole, but experience has demonstrated that the forces that can arise are so strong that the welding breaks and/or the plastic is delaminated from the flat anchorage plate, ref. FIGS. 1*a-b*. Similarly, attempts at adding various types of barbs and transverse boom means on such a flat anchorage plate have proved inadequate, ref. FIGS. 2*a-b*, as they have also led to the welding breaking and/or the plastic being delaminated.

The object of the present invention is to provide an anchorage system in connection with an oblong, round metal part that is cast into a flexible ski sole that prevents the disadvantages outlined above.

It is also an object to provide an anchorages system enabling greater flexibility in terms of positioning the pivot point of the binding point, which is often located at a portion of or an area of the ski sole, where there is little space and a short distance between the pivot point and the walk surface of the sole, which in turn means that there is only a thin layer of plastic for the metal part to be anchored.

Furthermore, it is an object to provide an anchorage system enabling the ski sole to obtain a more optimum flexibility along the entire sole, as the flexibility and other properties of the plastic material can be selected to optimize the flexibility without having to compromise as much on the choice of plastic material to ensure good or sufficient anchoring of the embedded metal binding part.

BRIEF COMMENTS ON THE DRAWINGS

Figure 2C:
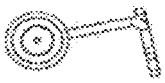
Fig. 2c Prior Art
Figure 3:
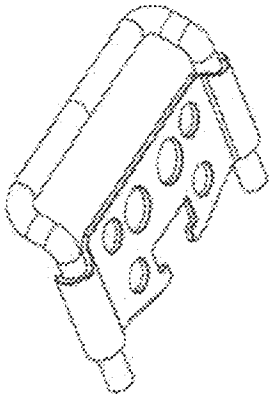
Fig. 3 Prior Art
Figure 4A:
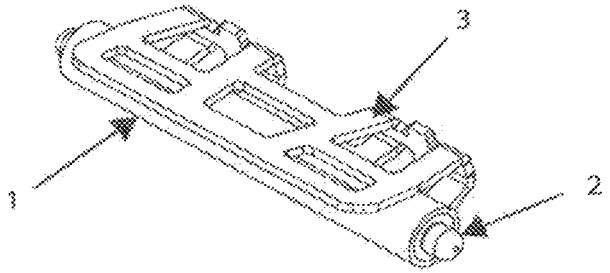
Figure 4B:
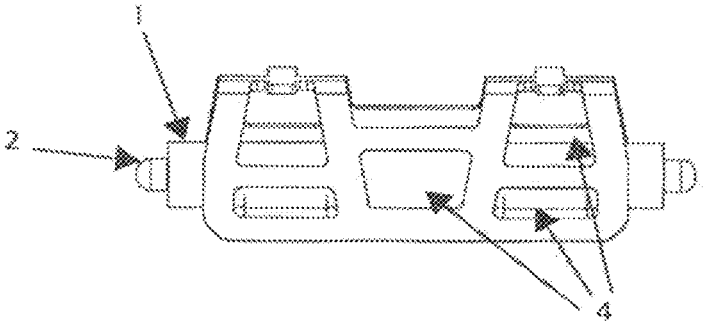
Figure 4C:
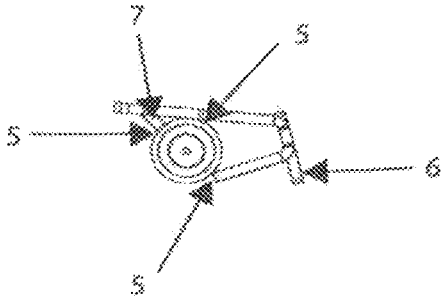
Figure 4D:
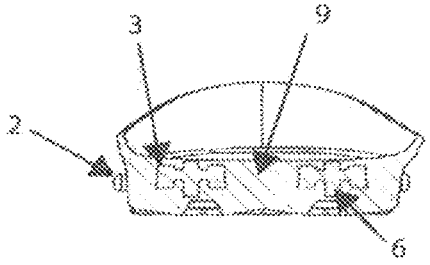
Figure 4E:
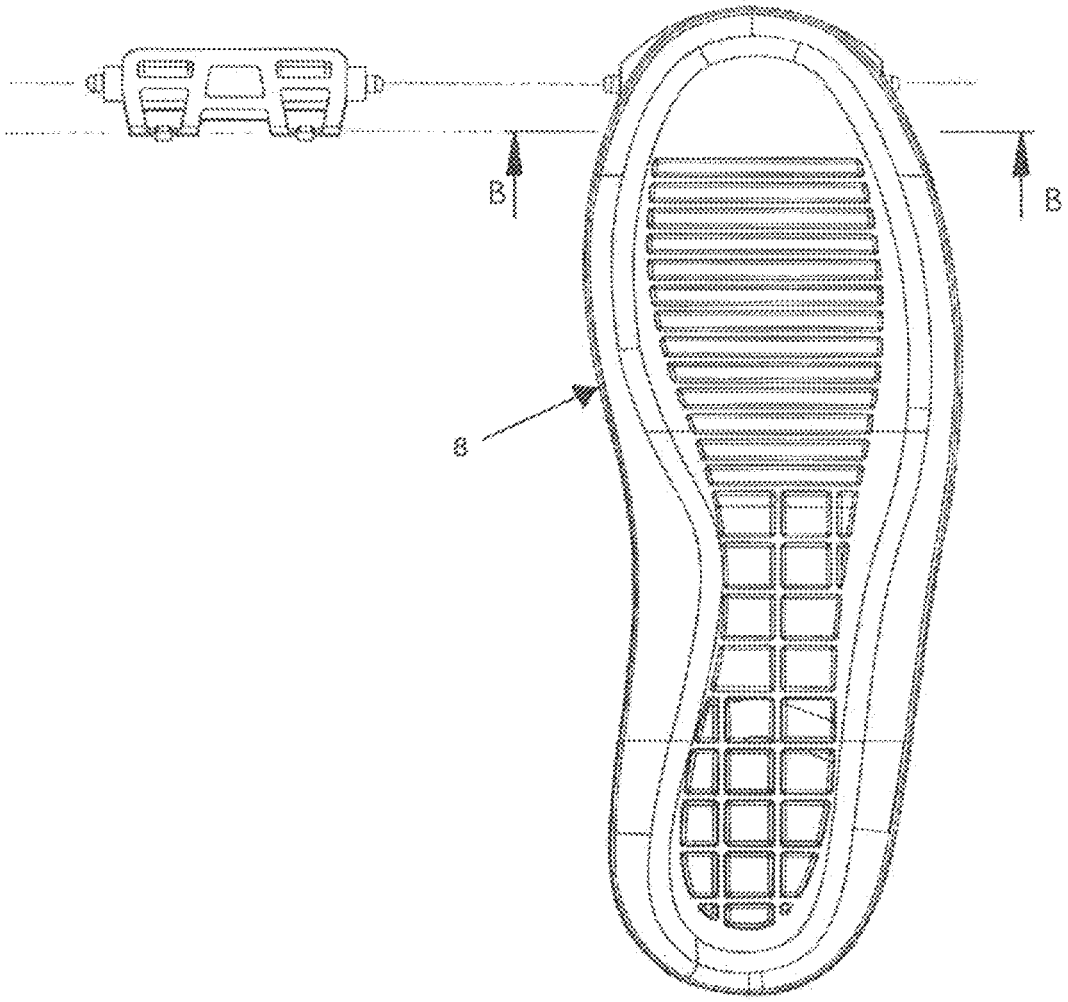
Figure 4G:
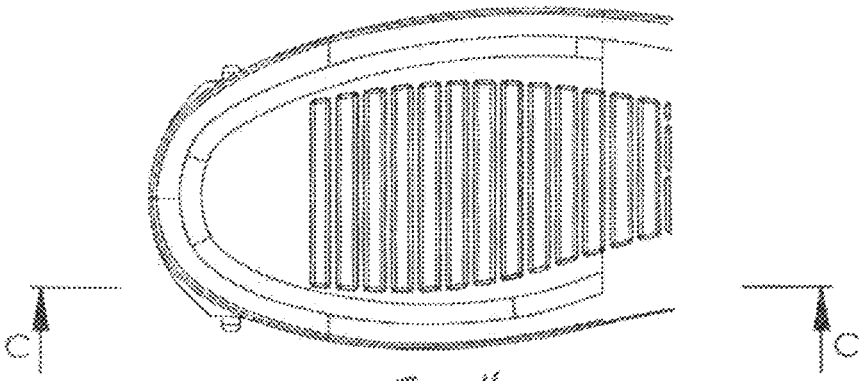
Figure 4F:
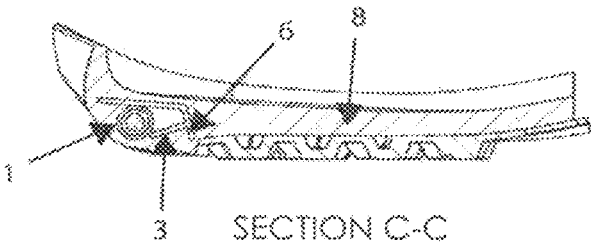
Figure 5A:
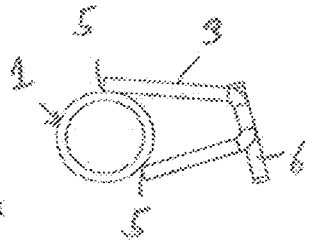
Figure 5B:
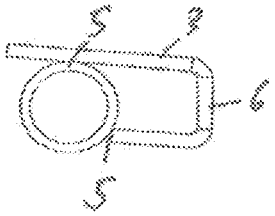
Figure 5C:
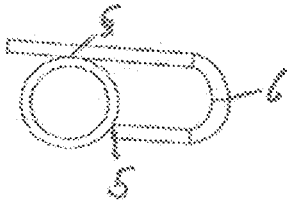
Figure 5D:
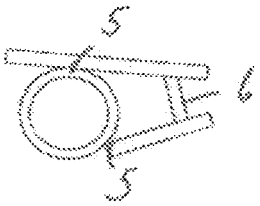
Figure 5E:
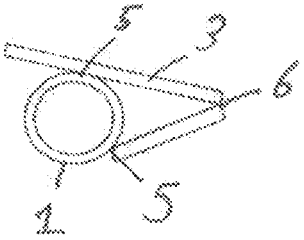
Figure 6C:
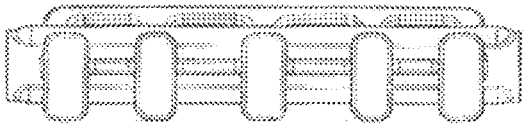
Figure 6D:
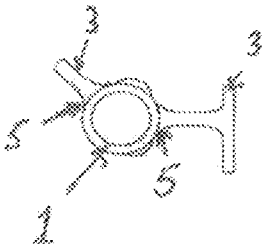
Figure 6B:
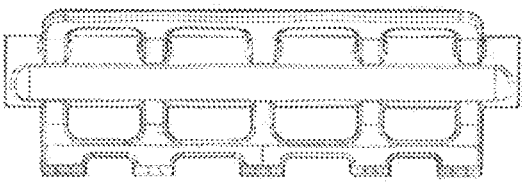
Figure 6A:
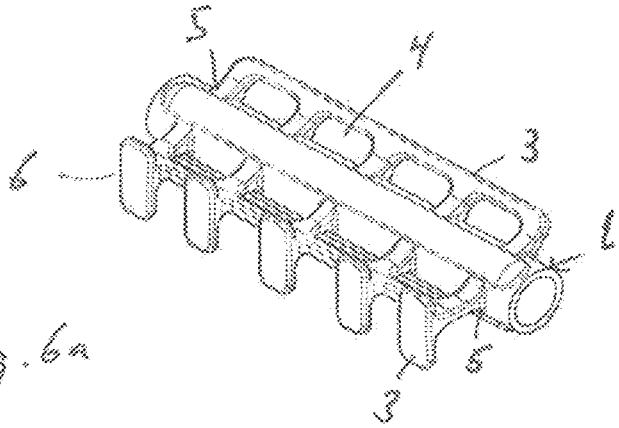

In the following, non-exhaustively, examples of possible embodiments of the invention are presented with reference to the accompanying figures, wherein:

FIGS. 1*a-b* show an embodiment of an anchorage system that has proved not to function properly, FIGS. 2*a-c* show another embodiment of an anchorage system that has proved not to function properly, FIG. 3 shows an example of how the pins in the previous NNN system are anchored, FIGS. 4*a-g* show a view, from different perspectives, of a possible embodiment of the present invention, FIGS. 5*a-e* show alternative embodiments of an anchorage for a binding part, and FIGS. 6*a-d* show an alternative embodiment of an anchorage on a binding part, wherein these are cast integrally by means of a plastic or composite material.

DETAILED DESCRIPTION

FIGS. 4*a-f* show an embodiment of the present invention comprising a binding part 1 that comprises an oblong, round metal part in the form of a tubular body with pins 2 projecting at either end. The binding part 1 is welded onto an anchorage part 3, in this case of a metal piece with punched-out openings 4 and holders-on 6. The metal piece is bent into a V-shape, —or perhaps a U-shape?—the holders-on 6 in this case forming two transverse booms. Two support booms 7 are also bent outwards. The opening or the space in the V-shaped metal piece is adapted, such that the binding part 1 fits between the support boom 7, the top of the one arm of the V-shaped metal piece and the inside of the other arm of the V-shaped metal piece. Along the tangent points between the V-shaped metal piece and the binding part 1, welding points 5 are arranged.

In the embodiment shown, three welding points 5 are shown in the periphery/circumference of the round binding part 1. By providing at least two welding points 5 in the circumference of the round binding part 1, it is ensured that the point load in a welding point 5 does not become so high that the welding risks breaking, when major torsion forces arise between a ski shoe 8, the binding part 1, the corresponding, complementary binding part, which is mounted fixedly onto a ski (not shown).

The V-shaped metal piece 3 with punched-out openings 4 is thus configured, such that a sufficient volume of a plastic material 9 has a space within the V-shaped metal piece 3, forming the anchorage body, as the cross section of the plastic material 9 in the punched-out openings 4 is sufficiently large for not being torn, when major torsion forces arise.

The V-shaped metal piece 3 and the location of the round binding part 1 in the opening of the V-shape ensures that the round binding part 1 can be located in an optimum or almost optimum position at the front of the ski shoe/sole 8, at a minimum distance between the axial centre of the pins 2 and the outer surface of the ski shoe/sole 8. To obtain this, the plastic material under and possibly in front of the round binding part 1 will (necessarily) have to be very thin, i.e. it cannot be so thick that it adds undesired height/thickness. This is desirable because the contact with and proximity to the ski can be important to obtain a good skiing experience and contact with the foundation. The configuration of the anchorage part 3 according to the present invention makes it possible to reduce the thickness of the plastic material 9 on the underside of the binding part 1 to a thickness that in itself would be nearly sufficient for holding the binding part 1 safely anchored in the ski shoe/sole.

It should be understood that instead of welding the V-shaped metal piece 3 and the round binding part 1, glue or other suitable fasteners can be used. It should also be understood that instead of bending a single metal piece into a V-shape, two or more metal pieces can be used that are put together to form a V-, U-, H-shape or the like, ref. FIGS. 5*a-e*, the crucial point is that the configuration results in at least to fixed points in the periphery/circumference of the round binding part 1, that there is room for a sufficient volume of the plastic material on the inside of the truss forming the anchorage part 3 and that the cross sections of the plastic material in the openings 4 are sufficiently large. It should be understood that the openings 4 can be closed or open holes.

Though an example is described above, in which the binding part 1 and the anchorage part 3 are made of metal and welded together, it is also possible to use other materials, such as plastic or composite materials that are glued, bonded or cast in one piece. FIGS. 6*a-d* show an example of such cast embodiment. When it is cast, there will be more degrees of freedom as to configuration, varying thicknesses based on the load profile (e.g. thicker right to the tubular binding part) as well as supporting profiles along e.g. the tubular binding part.

The solution according to the present invention is intended for flexible shoes, i.e. shoes that are flexible around the metatarsal zone or the toe ball. The plastic material in the shoe and the construction of the shoe can be adapted in many ways. A harder plastic can be used and processed thinner in certain zones to make it flexible, or a softer plastic can be used and processed relatively thicker to obtain the same or corresponding flexibility. The thickness of the various components has a strong effect on the experienced rigidity. These choices will give other outcomes as to the properties of the shoe, e.g. a thicker sole could result in standing higher up from the ski, which can have a negative impact on the skiing experience. Similarly, a thinner sole with harder plastic can give a more muted skiing experience. This means that compromises will have to be found, which in each case gives the desired result. For a ski shoe for classical skiing style, a softer and thinner sole will often be preferred, while a ski shoe for skating style can be stiffer and more muted. According to the invention, the plastic material used in the anchorage plastic/middle sole can have a Shore in the range from 35D to 65D, but it should be understood that it is also imaginable to use softer or stiffer types of plastic, i.e. a softer or harder Shore. It should be understood that the shoe can have walk surface, edge and/or bonding material elements, which are harder, typically with a Shore of 65A-98A. If the anchorage part is cast in a plastic material, a harder plastic material is used, typically Shore 50D or harder.

Attached is an independent claim indicating the features that are necessary to obtain anchorage of the binding part according to the present invention. Further alternative and advantageous features of the invention are indicated in the dependent claims.

The invention claimed is:

1. An anchorage assembly for ski shoe, comprising a binding part and an anchorage part, wherein the binding part comprises an oblong, round part with pins projecting at either end, wherein the binding part is configured to be arranged in a sole of the ski shoe, such that the pins project from a perimeter of the sole at either side of a front end of the sole transversely to the longitudinal direction of a ski, wherein the anchorage part comprises openings and holding elements, wherein the anchorage part forms an opening into which the binding part fits, the anchorage part and the binding part are attached to each other at least two fixed points in a circumference of the oblong, round part when viewed in an axial direction of the oblong, round part.

2. An anchorage assembly according to claim 1, wherein the anchorage part is made of a bent metal piece, forming a V-, U- or H-shape when viewed in the axial direction of the oblong, round part.

3. An anchorage assembly according to claim 1, wherein the anchorage part and the binding part are fastened to each other by at least one of welding, glue or other fasteners.

4. An anchorage assembly according to claim 1, wherein the anchorage part is cast with the binding part, and the holding elements are integrally formed with the fixed points.

5. An anchorage assembly according to claim 1, wherein the anchorage part is cast or integrated with the binding part.

6. An assembly according to claim 5, wherein the integrated anchorage part and the binding part are cast in a plastic material with a Shore of 50D or harder.

7. An anchorage assembly according to claim 1, wherein the openings constitute at least 35% of the total surface of the anchorage part and not more than 65%.

8. An assembly according to claim 1, wherein the sole, in which the binding part is anchored, is made of plastic and has a Shore in the range of 35D to 65D.

9. A ski shoe having an anchorage assembly in a sole of the ski shoe, wherein the anchorage assembly comprises a binding part and an anchorage part, wherein the binding part comprises an oblong, round part with pins projecting at either end, wherein the binding part is arranged in the sole, such that the pins project from a perimeter of the sole at either side of a front end of the sole transversely to the longitudinal direction of a ski, wherein the anchorage part comprises openings and holding elements, wherein the anchorage part forms an opening into which the binding part fits, the anchorage part and the binding part are attached to each other at at least two fixed points in a circumference of the oblong, round part when viewed in an axial direction of the oblong, round part.

10. A ski shoe according to claim 9, wherein the sole, in which the binding part is anchored, is made of plastic and has a Shore in the range of 35D to 65D.

11. A ski shoe according to claim 9, wherein the anchorage part and the binding part are cast in a plastic material with a Shore of 50D or harder.

* * * * *